US008619007B2

(12) United States Patent
Park et al.

(10) Patent No.: US 8,619,007 B2
(45) Date of Patent: Dec. 31, 2013

(54) ELECTRO-LUMINESCENCE DISPLAY DEVICE FOR IMPLEMENTING COMPACT PANEL AND DRIVING METHOD THEREOF

(75) Inventors: Jae Deok Park, Gyeongsangbuk-do (KR); Du Hwan Oh, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1010 days.

(21) Appl. No.: 11/374,020

(22) Filed: Mar. 14, 2006

(65) Prior Publication Data

US 2006/0238134 A1 Oct. 26, 2006

(30) Foreign Application Priority Data

Mar. 31, 2005 (KR) ..... 10-2005-0026919

(51) Int. Cl.
*G09G 3/30* (2006.01)

(52) U.S. Cl.
USPC ..... 345/76

(58) Field of Classification Search
USPC ..... 345/76
See application file for complete search history.

(56) References Cited

U.S. PATENT DOCUMENTS 5,151,689 A * 9/1992 Kabuto et al. ..... 345/103
5,892,493 A * 4/1999 Enami et al. ..... 345/94
5,973,456 A * 10/1999 Osada et al. ..... 315/169.1
6,088,010 A * 7/2000 Makino et al. ..... 345/60
6,091,392 A * 7/2000 Imamura ..... 345/100
6,184,853 B1 * 2/2001 Hebiguchi et al. ..... 345/88
6,246,385 B1 * 6/2001 Kinoshita et al. ..... 345/87
6,339,415 B2 * 1/2002 Ishizuka ..... 345/76
6,411,047 B1 * 6/2002 Okazaki et al. ..... 315/312
6,504,520 B1 * 1/2003 Osada et al. ..... 345/76
6,894,667 B1 * 5/2005 Lin ..... 345/87
7,385,576 B2 6/2008 Moon
7,522,145 B2 4/2009 Lee et al.
2001/0013852 A1 * 8/2001 Matsushima et al. ..... 345/92
2002/0033809 A1 * 3/2002 Nakajima ..... 345/204
2002/0163490 A1 11/2002 Nose
2003/0016193 A1 * 1/2003 Amatsuchi et al. ..... 345/60
2003/0043104 A1 3/2003 Lee et al.
2003/0117355 A1 6/2003 Yamauchi (Continued)

FOREIGN PATENT DOCUMENTS

CN 1407527 A 4/2003
CN 1428630 A 7/2003

(Continued)

OTHER PUBLICATIONS

Office Action issued Dec. 18, 2009 in corresponding Chinese Application No. 2006100670136.

(Continued)

*Primary Examiner* — William Boddie
*Assistant Examiner* — Andrew Schnirel
(74) *Attorney, Agent, or Firm* — Morgan, Lewis & Bockius LLP

(57) ABSTRACT

An electro-luminescence display device includes: an electro-luminescence display panel including red, green and blue subpixels in regions defined by a plurality of data lines and a plurality of scan lines; a scan driver integrated circuit for driving the scan lines; and a data driver integrated circuit for driving the data lines, wherein the data driver integrated circuit has no more output channels than half of the plurality of datelines.

2 Claims, 7 Drawing Sheets

(56) References Cited

U.S. PATENT DOCUMENTS

| | | | | |
|---|---|---|---|---|
| 2003/0174106 | A1 | 9/2003 | Tanada et al. | |
| 2003/0231152 | A1* | 12/2003 | Shin | 345/83 |
| 2004/0119672 | A1* | 6/2004 | Lee et al. | 345/87 |
| 2004/0125065 | A1* | 7/2004 | Park et al. | 345/92 |
| 2004/0233184 | A1 | 11/2004 | Toriumi et al. | |
| 2004/0257322 | A1* | 12/2004 | Moon | 345/87 |
| 2005/0237280 | A1* | 10/2005 | Oh et al. | 345/76 |
| 2005/0243034 | A1* | 11/2005 | Chung et al. | 345/76 |
| 2006/0232541 | A1* | 10/2006 | Kudo et al. | 345/98 |
| 2008/0204390 | A1 | 8/2008 | Moon | |

FOREIGN PATENT DOCUMENTS

| | | | |
|---|---|---|---|
| CN | 1514424 | A | 7/2004 |
| CN | 1573459 | A | 2/2005 |
| JP | 7-13511 | A | 1/1995 |
| JP | 10-260661 | A | 9/1998 |
| JP | 2001-312243 | A | 11/2001 |
| JP | 2002-149125 | A | 5/2002 |
| JP | 2002-333866 | A | 11/2002 |
| JP | 2003-58075 | A | 2/2003 |
| JP | 2003-114646 | A | 4/2003 |
| JP | 2003-271100 | A | 9/2003 |
| JP | 2004-29477 | A | 1/2004 |
| JP | 2004-145281 | A | 5/2004 |
| JP | 2004-198493 | A | 7/2004 |
| JP | 2005-49838 | A | 2/2005 |
| JP | 2006-018297 | A | 1/2006 |
| KR | 1020030020185 | A | 3/2003 |
| KR | 1020050000105 | A | 1/2005 |
| KR | 100803163 | B1 | 2/2008 |
| TW | I277938 | B | 4/2007 |
| WO | 03-091979 | A1 | 4/1991 |

OTHER PUBLICATIONS

Office Action issued Dec. 7, 2009 in corresponding German Application No. 10 2006 014 873.8-32.

Office Action issued Mar. 30, 2010 in corresponding Japanese Application No. 2006-098572.

Chinese Office Action (Application No. 200610067013.6), dated Jul. 3, 2012, with English translation.

* cited by examiner

ELECTRO-LUMINESCENCE DISPLAY DEVICE FOR IMPLEMENTING COMPACT PANEL AND DRIVING METHOD THEREOF

This application claims the benefit of Korean Patent Application No. 10-2005-0026919, filed on Mar. 31, 2005, which is hereby incorporated by reference in its entirety.

BACKGROUND OF THE INVENTION

1.Field of the Invention

The present invention relates to a display device and a driving method thereof, and more particularly, to an electro-luminescence display device and a driving method thereof.

2.Description of the Related Art

Cathode ray tubes (CRTs) are heavy and bulky as display devices. To solve these disadvantages of the CRTs, flat display devices have been developed. Examples of flat display devices include a liquid crystal display device (LCD), a field emission display device (FED), a plasma display device (PDP), and an electro-luminescence (EL) display device. The EL display device is a self-luminous device that emits light from a fluorescent material in which recombination of electrons and holes occurs. The EL display device can be classified into an inorganic EL display device and an organic EL display device, depending on the fluorescent materials and structures used. Unlike the LCD, the organic EL display device does not require a separate light source. Therefore, the organic EL display (hereinafter, referred to as an OLED) device has a rapid response time comparable to that of the CRT.

FIG. 1 is a cross-sectional view of an EL cell in a related art organic electro-luminescence display panel. More specifically, FIG. 1 is a cross-sectional view of an organic EL structure for explaining the light emitting structure of the OLED device. Referring to FIG. 1, the OLED device includes an electron injection layer 4, an electron transport layer 6, an organic emission layer 8, a hole transport layer 10, and a hole injection layer 12, which are sequentially stacked between a cathode 2 and an anode 14. When a predetermined voltage is applied between a transparent electrode as the anode 14 and a metal layer as the cathode 2, electrons from the cathode 2 move toward the emission layer 8 through the electron injection layer 4 and the electron transport layer 6. Also, holes from the anode 14 move toward the organic emission layer 8 through the hole injection layer 12 and the hole transport layer 10. The electrons from the electron transport layer 6 and the holes from the hole transport layer 10 recombine in the organic emission layer 8, thereby generating light. Then, the light is emitted to the outside through the transparent electrode anode 14 of the transparent electrode.

FIG. 2 is a circuit diagram of a related art organic EL display device. Referring to FIG. 2, the related art OLED device includes an organic EL display panel 16, a scan driver integrated circuit (scan D-IC) 18, a data driver integrated circuit (data D-IC) 20, and a timing controller 26. The OLED panel 16 includes subpixels 22 formed on regions defined by a plurality of scan lines SL1 to SLn and a plurality of data lines DL1 to DLm that cross each other. The scan D-IC 18 drives the scan lines SL1 to SLn, and the data D-IC 20 drives data lines DL1 to DLm. Additionally, the timing controller 26 controls the driving timing of the data D-IC 20 and the scan D-IC 18. Each of the subpixels 22 includes a power source VDD, a ground source GND, an OLED cell connected between the power source VDD and the ground source GND, and an OLED driver circuit 24 for driving the OLED cell in response to driving signals supplied from the data line DL and the scan line SL. One pixel is constructed with red (R), green (G) and blue (B) subpixels that are horizontally arranged adjacent to one another.

The OLED driver circuit 24 includes: a driving thin film transistor (hereinafter, referred to as a TFT) DT connected between the power source VDD and the OLED device: a first switching TFT T1 connected to the scan line SL and the data line DL; a second switching TFT T2 connected to the first switching TFT T1 and driving TFT DT; a converting TFT MT connected between the power source VDD and a node of the first switching TFT T1 and the second switching TFT T2, the converting TFT MT forming a current mirror circuit together with the driving TFT DT to convert a current into a voltage; and a storage capacitor Cst connected between the power source VDD and a node of gates of the driving TFT DT and the converting TFT MT. The driving TFT DT, the converting TFT MT, the first switching TFT T1 and the second switching T2 are formed of p-type metal-oxide semiconductor field effect transistors (MOSFETs).

The driving TFT DT has a gate connected to the gate of the converting TFT MT, a source connected to the power source VDD, and a drain connected to the OLED device. The converting TFT MT has a source connected to the power source VDD, and a drain connected to a drain of the first switching TFT T1 and a source of the second switching TFT T2. The first switching TFT T1 has a source connected to the data line DL, and a drain connected to a source of the second switching TFT T2. The second switching TFT T2 has a drain connected to the gates of the driving TFT DT and the converting TFT MT and the storage capacitor Cst.

The first and second switching TFTs T1 and T2 have gates connected to the scan line SL. The converting TFT MT and the driving TFT DT form a current mirror circuit because they were formed to have the same electrical characteristics. If the converting TFT MT and the driving TFT DT are the same, the amount of current flowing through the converting TFT MT will be identical to the amount of current flowing through the driving TFT DT.

The timing controller 26 generates a data control signal for controlling the data D-IC 20 and a scan control signal for controlling the scan D-IC 18 by using synchronization signals supplied from an external system, such as a graphic card. Also, the timing controller 26 supplies the data D-IC 20 with a video data supplied from the external system. The scan D-IC 18 generates scan signals in response to the scan control signal supplied from the timing controller 26.

FIG. 3 is a waveform of scan signals supplied to scan lines of FIG. 2. As illustrated in FIG. 3, the scan signals are supplied to the scan lines SL1 to SLn, so that the scan lines SL1 to SLn are sequentially driven. The data D-IC 20 supplies the data lines DL1 to DLm with data signals having a current level or a pulse width responsive to the video data at every horizontal period 1H according to the data control signal supplied from the timing controller 26. At this point, the data D-IC 20 has m number of output channels 21 that match with the data lines DL1 to DLm in 1:1 correspondence.

The data D-IC 20 supplies each of the subpixels 22 with the data signal having a current level or a pulse width proportional to an input data. Each of the subpixels 22 emits light in proportion to an amount of the current supplied from the data line DL. Because a pixel is constructed of red (R), green (G) and blue (B) subpixels horizontally arranged, three data lines and one scan line are required to drive the related art pixel.

In the related art OLED device, the scan D-IC 18 has outputs that are matched 1:1 with the scan lines SL1 to SLn in a row direction of the organic EL display panel 16, and the data D-IC 20 has channels 21 matched 1:1 with the data lines DL1 to DLm in a column direction of the organic EL display panel 16. Since the output channels 21 of the data D-IC 20 are matched 1:1 with the data lines DL1 to DLm, as many output channels 21 of the data D-IC 20 are required as there are data lines DL1 to DLm. Consequently, the related art organic EL display device has drawbacks in that the price of the data D-IC 20 increases as the number of the output channels 21 of the data D-IC 20 increases. In turn, the number of output channels 21 increases as the size of the OLED panel 16 increases.

SUMMARY OF THE INVENTION

Accordingly, the present invention is directed to an electro-luminescence display device and a driving method thereof that substantially obviate one or more problems due to limitations and disadvantages of the related art.

An object of the present invention is to provide an EL display device and a driving method thereof, in which the number of output channels of a data integrated circuit can be minimized.

Another object of the present invention is to provide an EL display device and a driving method thereof, in which the data integrated circuit can be built in a panel Another object of the present invention is to provide an EL display device and a driving method thereof, is to reduce manufacturing cost and implement a compact panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electro-luminescence display device includes: an electro-luminescence display panel including red, green and blue subpixels in regions defined by a plurality of data lines and a plurality of scan lines; a scan driver integrated circuit for driving the scan lines; and a data driver integrated circuit for driving the data lines, wherein the data driver integrated circuit has no more output channels than half of the plurality of datelines.

In another aspect, an electro-luminescence display device includes: an electro-luminescence display panel including red, green and blue subpixels in regions defined by a plurality of data lines formed in a column direction and a plurality of scan lines formed in a row direction; a first scan driver integrated circuit on one side of the electro-luminescence display panel; and a second scan driver integrated circuit on an opposite side of the electro-luminescence display panel, wherein the first set of scan lines and the second set of scan lines are connected in an alternating fashion to the subpixels in a row direction across the electro-luminescence display panel.

In another aspect, an electro-luminescence display device includes: an electro-luminescence display panel including red, green and blue subpixels in regions defined by a plurality of data lines and a plurality of scan lines; a scan driver integrated circuit for driving the scan lines; a data driver integrated circuit for driving the data lines; and a multiplexer part for selectively connecting output channels of the data driver integrated circuit to one of at least every two of the data lines, wherein the red, green and blue subpixels are arranged in the same direction as the plurality of data lines and form a unit pixel.

In yet another aspect, a method of driving an electro-luminescence display device including an electro-luminescence display panel including red, green and blue subpixels at regions defined by a plurality of data lines and a plurality of scan, a scan driver integrated circuit for driving the scan lines and a data driver integrated circuit for driving the data lines, and a multiplexer part for selectively connecting output channels of the data driver integrated circuit to one of at least every two of the data lines, the method includes: supplying the multiplexer part with select signals of at least two multiplex clock signals; applying a first select signal of the multiplex clock signals to connect output channels of the data driver integrated circuit to subpixels connected to odd scan lines; and applying a second select signal of the multiplex clock signals to connect output channels of the data driver integrated circuit to subpixels connected to even scan lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
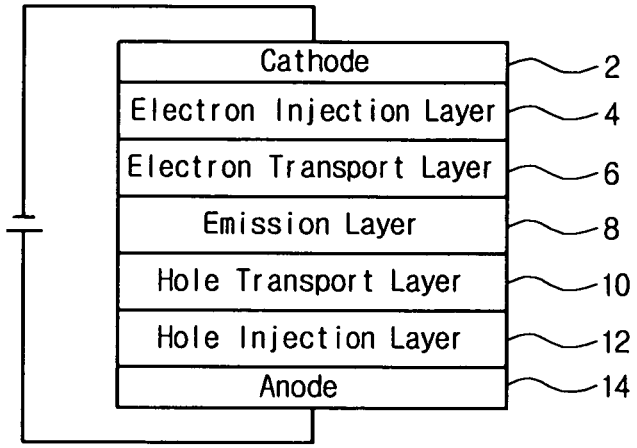
Fig. 1 (Related Art)
FIG. 1 is a cross-sectional view of an EL cell in a related art organic electro-luminescence display panel.
Figure 2:
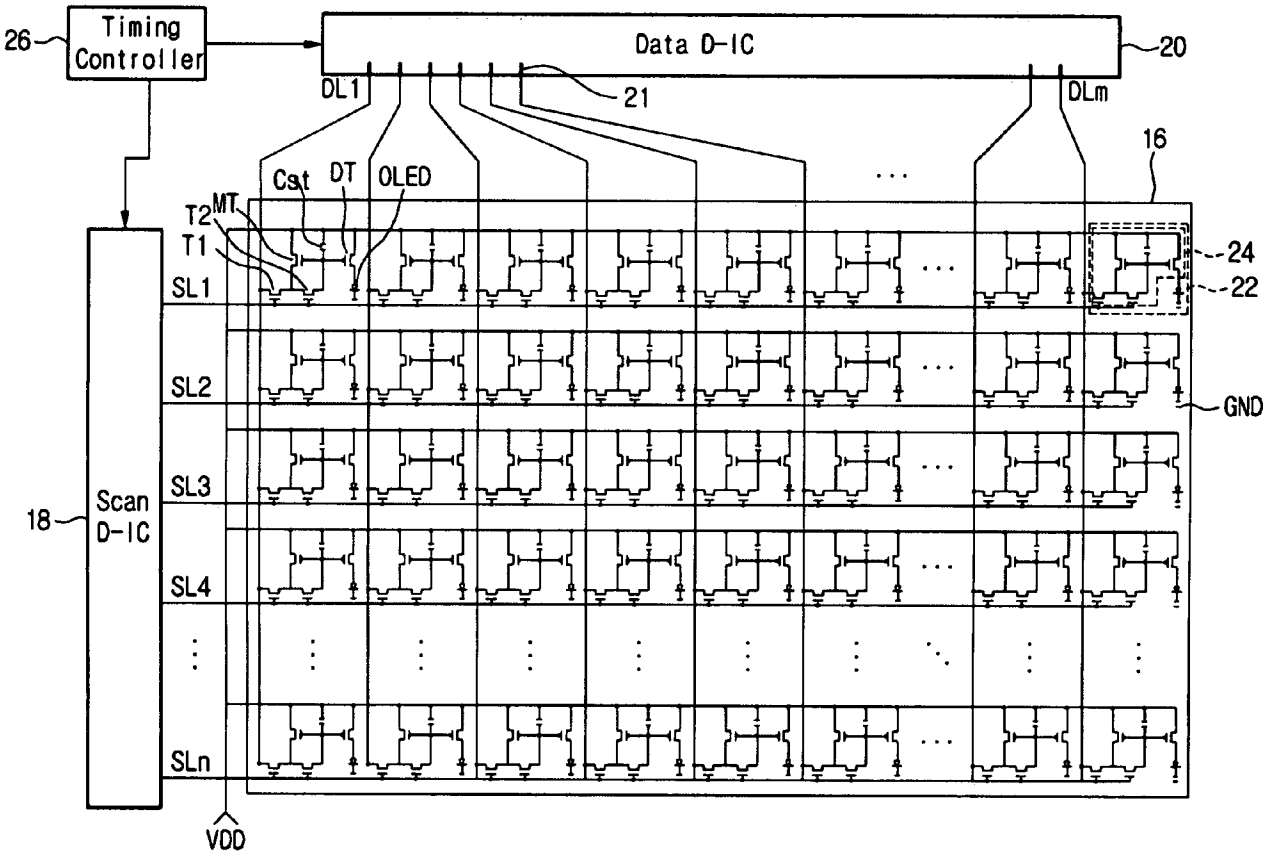
Fig. 2 (Related Art)
FIG. 2 is a circuit diagram of a related art organic EL display device.
Figure 3:
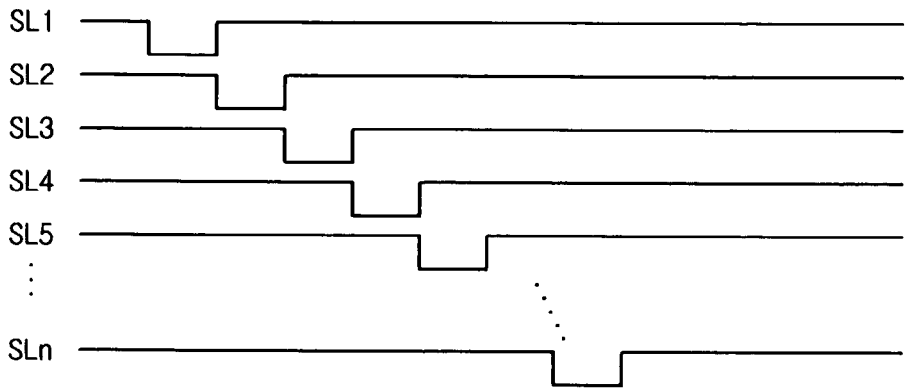
Fig. 3 (Related Art)
FIG. 3 is a waveform of scan signals supplied to scan lines of FIG. 2.
Figure 4:
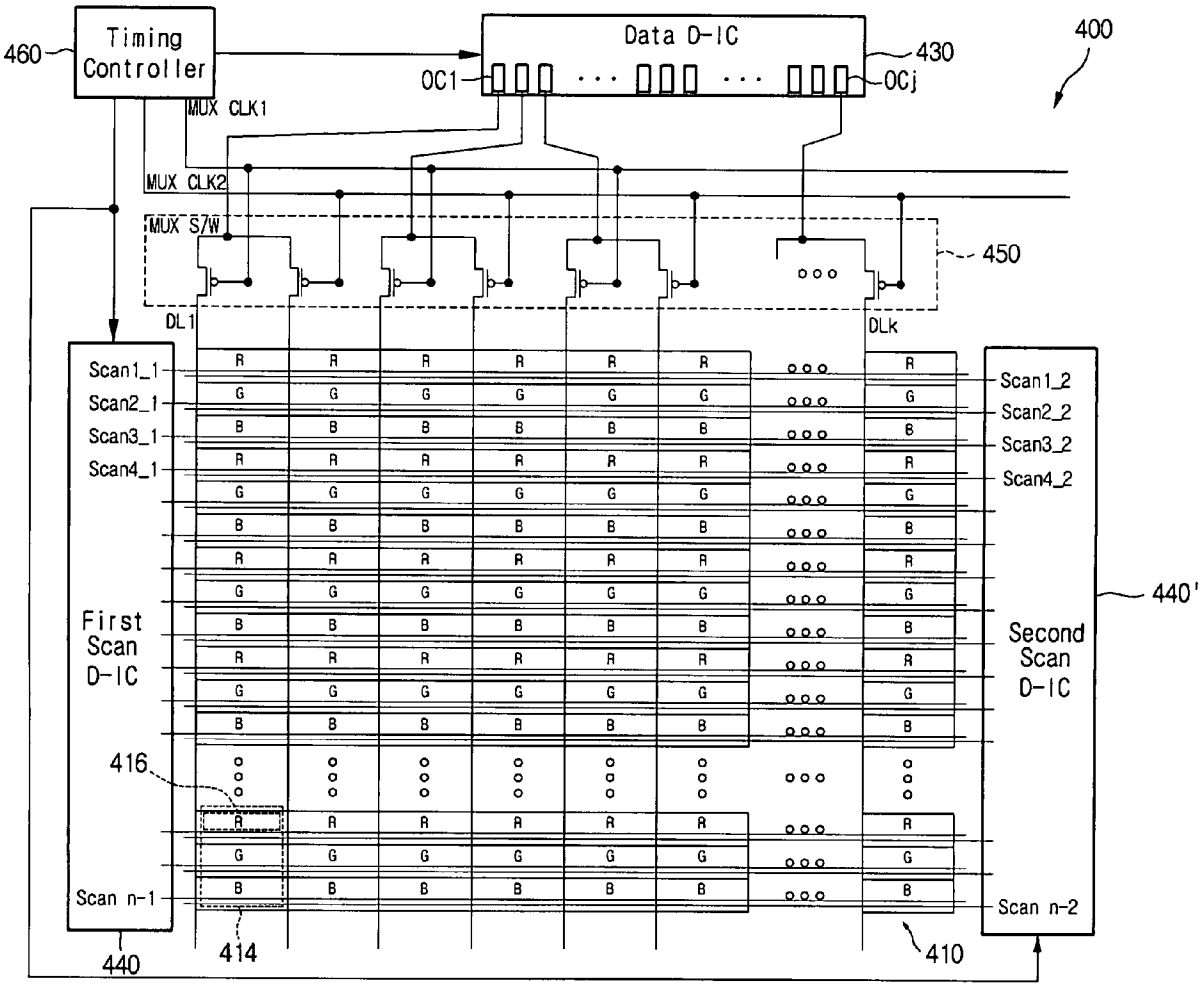
FIG. 4 shows an EL display device according to an embodiment of the present invention.

FIG. 4 shows an EL display device according to an embodiment of the present invention. Referring to FIG. 4, the EL display device 400 according to an embodiment of the present invention includes an EL display panel 410 having a plurality of subpixels 416 formed in regions defined by scan lines SL1_1 to SLn_1 and SL1_2 to SLn_2, and data lines DL1 to DLk, a scan driver integrated circuit (hereinafter, referred to as a scan D-IC) 440 for driving the scan lines, a data driver integrated circuit (hereinafter, referred to as a data D-IC) 430 for driving the data lines, a multiplexer part 450 for selectively connecting each of output channels OC1 to OCj of the data D-IC 430 to i number of data lines DL1 to DLk (where "i" is a positive integer greater than 2), and a timing controller 460 for controlling the driving timing of the data D-IC 430 and the scan D-IC 440.

As illustrated in FIG. 4, red (R), green (G) and blue (B) subpixels 416 are arranged in a column direction, which is the same direction as the data lines DL, and thus have a vertical stripe shape in configuring one pixel 414. The vertical stripe type pixel 414 is constructed with the R, G and B subpixels arranged in a column direction, rather than a row direction. As discussed above with regard to the related art pixel, three data lines and one scan line are required to drive the related art pixel. In contrast, one data line and three scan lines are required to drive the vertical stripe type pixel 414 in an embodiment of the present invention.

That is, in the related art, the R, G and B subpixels are arranged in a row direction and thus three data lines extending from an upper portion of the panel are required. Also, one scan line extending from a side portion of the panel passes through the R, G and B subpixels of the related art and drives them. In the case of the vertical stripe type pixel 414, since the R, G and B subpixels are arranged in a column direction, three scan lines extending from the side portion of the panel are required and one data line extending from the upper portion of the panel passes through the R, G and B subpixels arranged in a column direction and drives the R, G and B subpixels.

The EL display device 410 having the vertical stripe type pixel 414 can reduce the number of output channels OC1 to OCj of the data D-IC 430 by ⅓, as compared to the related art. A i number of multiplex clock signals MUX CLK are applied to the multiplexer part 450 such that each of the output channels OC1 to OCj of the data D-IC 430 is selectively connected to i number of data lines DL1 to DLk (where "i" is a positive integer greater than 1). Thus, the number of output channels OC1 to OCj of the data D-IC 430 required to drive the data lines DL can be reduced by 1/i. In the embodiment shown in FIG. 4, two multiplex clocks MUX CLK are provided and one of at least every two data lines is selectively connected to each of the output channels of the data D-IC 430. However, in an embodiment of the present invention is not limited such a configuration. Each of the output channels OC1 to OCj of the data D-IC 430 can be multiplexed with three or more data lines, which will further reduce the number of output channels OC1 to OCj of the data D-IC 430 required to drive the data lines DL. Consequently, the EL display device of the present invention allows the output channels OC1 to OCj of the data D-IC 430 by ⅓i compared with them of the related art data D-IC.

Referring again to FIG. 4, assuming that two multiplex clock signals are used, a pair of scan D-ICs 440 and 440', that is, a first scan D-IC 440 and a second D-IC 440', are provided at right and left sides of the EL display panel 410. The scan lines SL1_1 to SLn_1 extending from the first scan D-IC 440 and the scan lines SL1_2 to SLn_2 extending from the second scan D-IC 440' are connected in an alternating fashion to the subpixels 416 in a row direction across the EL display panel 410. That is, one of the pair of the electrode lines SL1_1 to SLn_1 driven by the first scan D-IC 440 and SL1_2 to SLn_2 driven by the second scan D-IC 440' is connected to the subpixel 416 constituting the vertical stripe type pixel 414. For example, the scan lines SL1_1 to SLn_1 driven by the first scan D-IC 440 are connected to the odd subpixels, and the scan lines SL1_2 to SLn_2 driven by the second scan D-IC 440' are connected to the even subpixels.

In the EL display device of FIG. 4, the two multiplex clocks MUX CLK multiplexer 450 together with and the vertical stripe type pixel 414 structure can reduce the number of output channels OC1 to OCj of the data D-IC 430 required to drive the data lines DL can be reduced by ⅙. More specifically, since the two multiplex clocks MUX CLK multiplexer 450 reduces the number of output channels OC1 to OCj of the data D-IC 430 by ½ and the vertical stripe type pixel 414 reduces the number of output channels OC1 to OCj of the data D-IC 430 by ⅓, the overall reduction is ½ times ⅓, which is ⅙. Thus, a D-IC can be used that has ⅙ of the output channels as compared with the related art, thereby reducing a manufacturing cost and implementing a compact panel.

Figure 5:
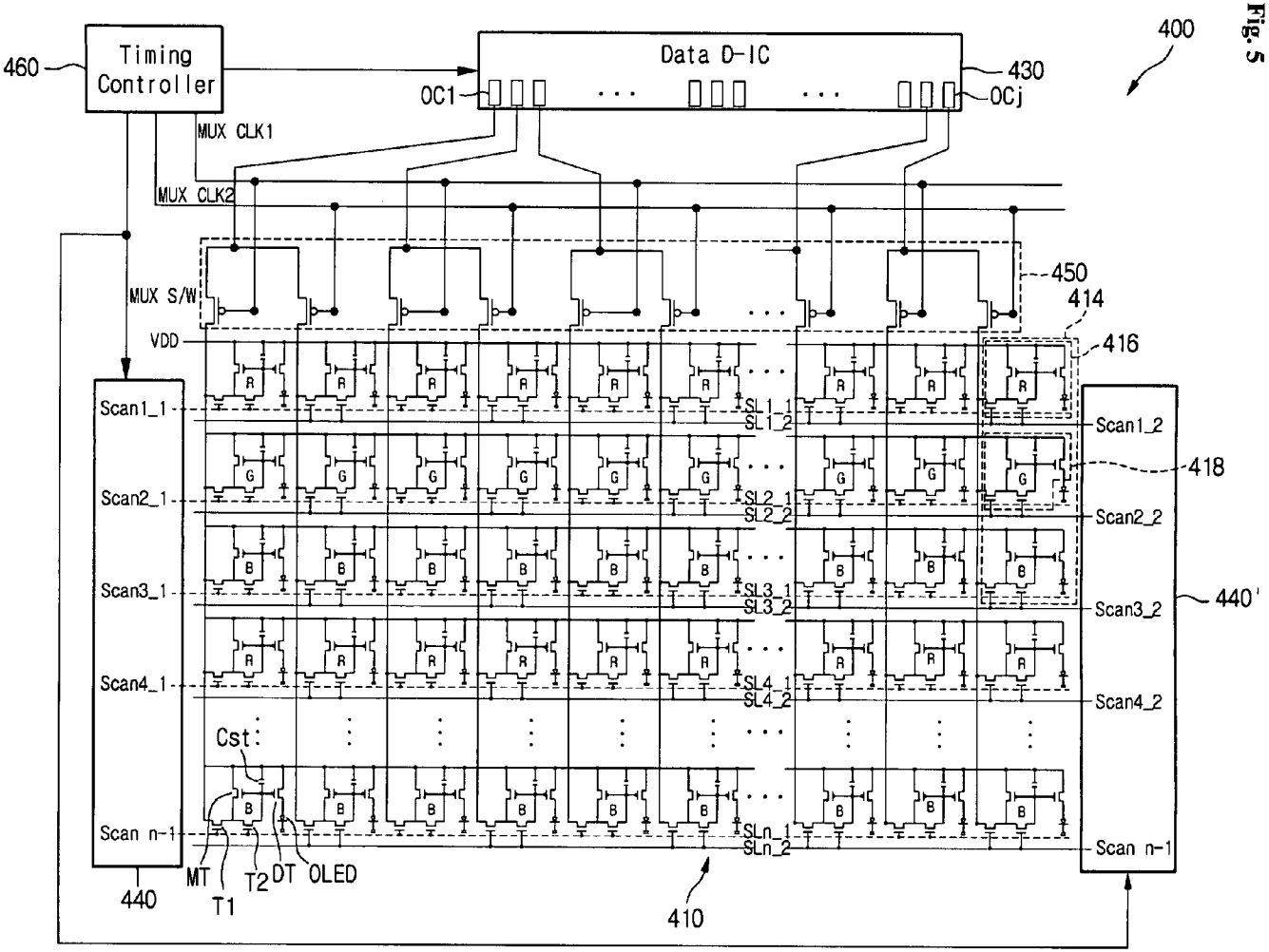
FIG. 5 is a circuit diagram of the EL display device illustrated in FIG. 4.

FIG. 5 is a circuit diagram of the EL display device of FIG. 4 in detail. Referring to FIGS. 4 and 5, the EL display device 400 according to an embodiment of the present invention can reduce the number of the outputs OC1 to OCj of the data D-IC 430 using both the vertical stripe type pixel structure, and reduces 1/i times the number of output channels of the data D-IC by using the multiplexer part 450 and i number of multiplex clock signals MUX CLK such that the ratio of channel outputs OC1 to OCj to data lines DL is 1/i, thereby reducing manufacturing cost and implementing a compact EL display panel. Here, the multiplexer part 450 selectively connects the output channels OC1 to OCj of the data D-IC 430 to 1/i of data lines DL1 to DLk (where "i" is a positive integer equal to or greater than 2). Thus, data D-IC 430 in embodiments of the present invention will have no more output channels OC1 to OCj than half of the plurality of datelines DL.

When the multiplexer part 450 and the i number of the multiplex clock signals are provided, the scan lines have to be increased by i times and the pulse width of the scan electrode signal is narrower 1/(3*i) times, as compared to the related art. However, even if the pulse width of the scan electrode signal is applied with 1/(3*i) times narrow width, there is no problem in driving the EL display device. It will be assumed in embodiments of FIGS. 4 and 5 that two multiplex clock signals are provided, two scan lines per subpixel line are provided, and their pulse width is narrow about ⅙ times, as compared to the related art.

In this embodiment, a 1_1 scan line Scan1_1 and a 1_2 scan line Scan1_2 are divided and provided to a first subpixel line. A sum of pulse widths of the 1_1 scan signal Scan1_1 and the 1_2 scan signal Scan 1_2 is equal to ⅙ times the pulse width of the first scan signal Scan1 of the related art. The first scan D-IC 440 and a second D-IC 440', are provided at right and left sides of the EL display panel 410. The scan lines SL1_1 to SLn_1 extending from the first scan D-IC 440 and the scan lines SL1_2 to SLn_2 extending from the second scan D-IC 440' are connected in an alternating fashion to the subpixels 416 in a row direction across the EL display panel 410. That is, one of the pair of the electrode lines SL1_1 to SLn_1 driven by the first scan D-IC 440 and the other of the pair of the electrode lines SL1_2 to SLn_2 driven by the second scan D-IC 440' are alternatively connected to the subpixels 416 each constituting the vertical stripe type pixel 414. For example, the scan lines SL1_1 to SLn_1 driven by the first scan D-IC 440 are connected to the odd subpixels, and the scan lines SL1_2 to SLn_2 driven by the second scan D-IC 440' are connected to the even subpixels.

The pixel 414 is formed in a vertical stripe shape as described above. In the case of the vertical stripe type pixels, the R, G and B subpixels 416 are adjacently arranged in a column direction, not in a row direction.

Referring to FIG. 5, each of the subpixels 416 includes an electro-luminescent (EL) cell connected between a power source VDD and a ground source GND, and an EL driver circuit 418 for driving the EL cell in response to driving signals supplied from the data line DL and the scan line SL.

The EL driver circuit 418 includes: a driving TFT DT connected between the power source VDD and the EL cell; a first switching TFT T1 connected to the scan line SL and the data line DL; a second switching TFT T2 connected to the first switching TFT T1 and the driving TFT DT; a converting TFT MT connected between the power source VDD and a node of the first switching TFT T1 and the second switching TFT T2, the converting TFT MT forming a current mirror circuit together with the driving TFT DT to convert a current into a voltage; and a storage capacitor Cst connected between the power source VDD and gates of the driving TFT DT and the converting TFT MT.

The driving TFT DT has a gate connected to the gate of the converting TFT MT, a source connected to the power source VDD, and a drain connected to the EL cell. The converting TFT MT has a source connected to the power source VDD, a drain connected to a drain of the first switching TFT T1, and a source connected to the second switching TFT T2. The first switching TFT T1 has a source connected to the data line DL, and a drain connected to a source of the second switching TFT T2. The second switching TFT T2 has a drain connected to the gates of the driving TFT DT and the converting TFT MT and the storage capacitor Cst. The first and second switching TFTs T1 and T2 have gates connected to the scan line Scan. The first and second switching TFTs T1 and T2 have gates connected to the scan line SL. The converting TFT MT and the driving TFT DT form a current mirror circuit because they were formed to have the same electrical characteristics. If the converting TFT MT and the driving TFT DT are the same, the amount of current flowing through the converting TFT MT will be identical to the amount of current flowing through the driving TFT DT.

In this manner, the EL display device according to embodiments of the present invention supplies each of the subpixels 416 with a data signal having a current level or a pulse width proportional to an input data. Each of the subpixels 416 emits light in proportion to an amount of the current or the pulse width supplied from the data line DL. The timing controller 460 generates a data control signal for controlling the data D-IC 430 and a scan control signal for controlling the scan D-IC 440 by using synchronization signals supplied from an external system, such as a graphics card. Also, the timing controller 460 rearranges a video data stream from the external system and supplies the data D-IC 430 with a rearranged video data stream.

Figure 6:
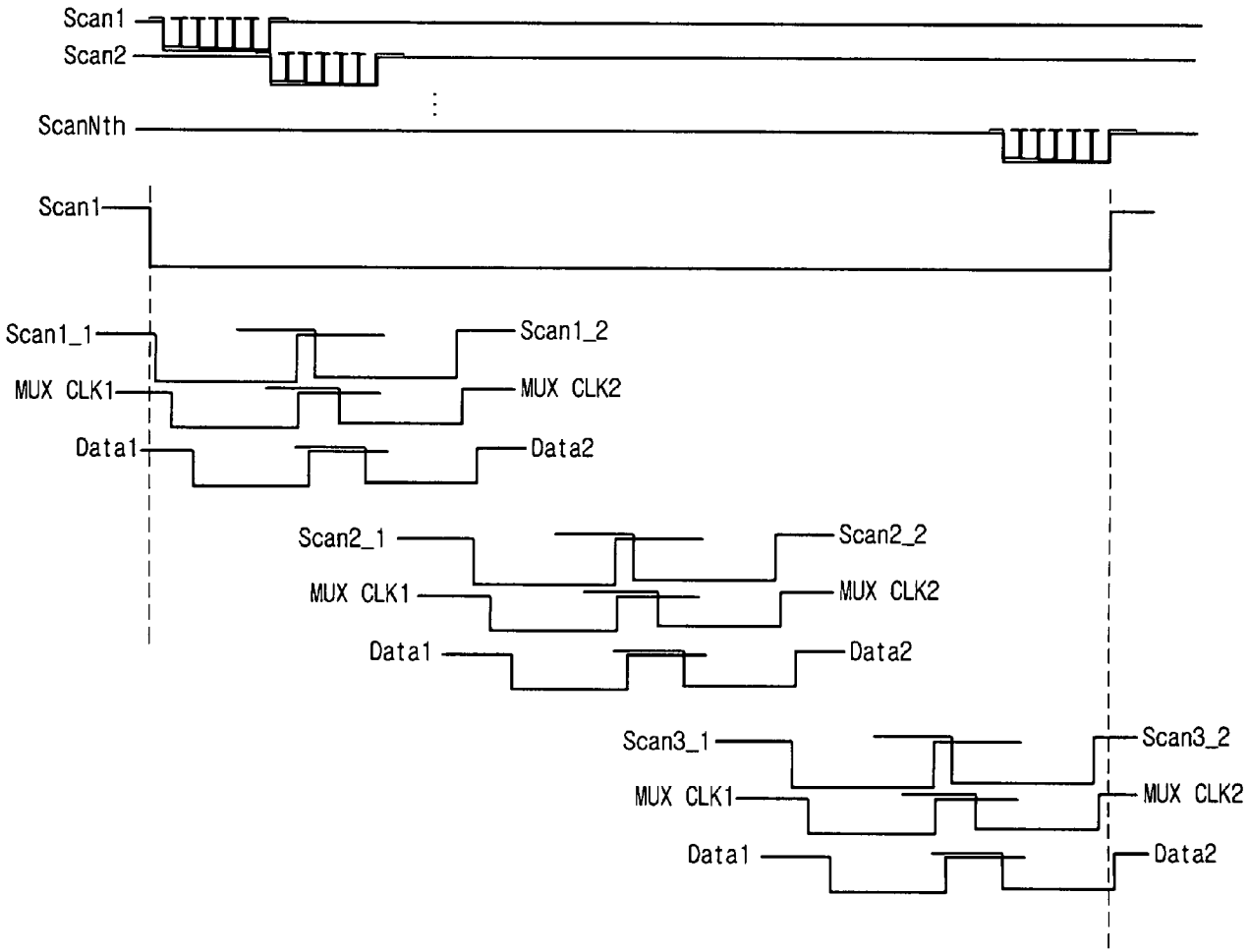
FIG. 6 illustrates signals applied to the EL display device according to the embodiment of the present invention, in comparison with signals generated in the related art EL display device.

FIG. 6 is a timing diagram of the signals applied to the EL display device according to an embodiment of the present invention. Here, it will be assumed that the multiplexer part operates in response to two multiplex clock signals, as illustrated in FIGS. 4 and 5. That is, first and second select signals MUX CLK1 and MUX CLK2 as two multiplex clock signals are supplied from the timing controller 460 to the multiplexer part 450, and the first and second select signals MUX CLK1 and MUX CLK2 have opposite polarities to each other.

Referring to FIG. 6, the scan signals supplied to the EL display device according to an embodiment of the present invention are sequentially inputted. Also, since two multiplex clock signals are provided, the scan signals are divided into two. In an embodiment of the present invention, the 1_1 scan signal Scan1_1 and the 1_2 scan signal Scan1_2 are separately supplied to the first subpixel line. A sum of the pulse widths of the 1_1 scan signal Scan1_1 and the 1_2 scan signal Scan1_2 is equal to ⅙ times the pulse width of the scan signal Scan1 of the related art. Therefore, a period of the first scan signal Scan1 of the related art is divided and occupied by the 1_1 scan signal Scan1_1 to the 3_2 scan signal Scan3_2. When the 1_1 scan signal Scan1_1 is turned on, the first select signal MUX CLK1 is also turned on, so that the odd subpixels on the first subpixel line are allowed to input their corresponding data. When the 1_1 scan signal Scan1_1 is turned off, the first select signal MUX CLK1 is also turned off.

Also, when the 1_2 scan signal Scan1_2 is turned on, the second select signal MUX CLK2 is turned on, so that the even subpixels on the first subpixel line are allowed to input their corresponding data. When the 1_2 scan signal Scan1_2 is turned off, the second select signal MUX CLK2 is also turned off. In other words, the first select signal MUX CLK1 maintains the on state during ⅙ of 1 horizontal period, and the second select signal MUX CLK2 maintains the on state during ⅙ of 1 horizontal period in which the first select signal MUX CLK1 is turned off. Also, the 1_1 scan signal Scan1_1 to the 3_2 scan signal Scan3_2 have scan pulses maintaining the on state during ⅙ of 1 horizontal period.

Figure 7:
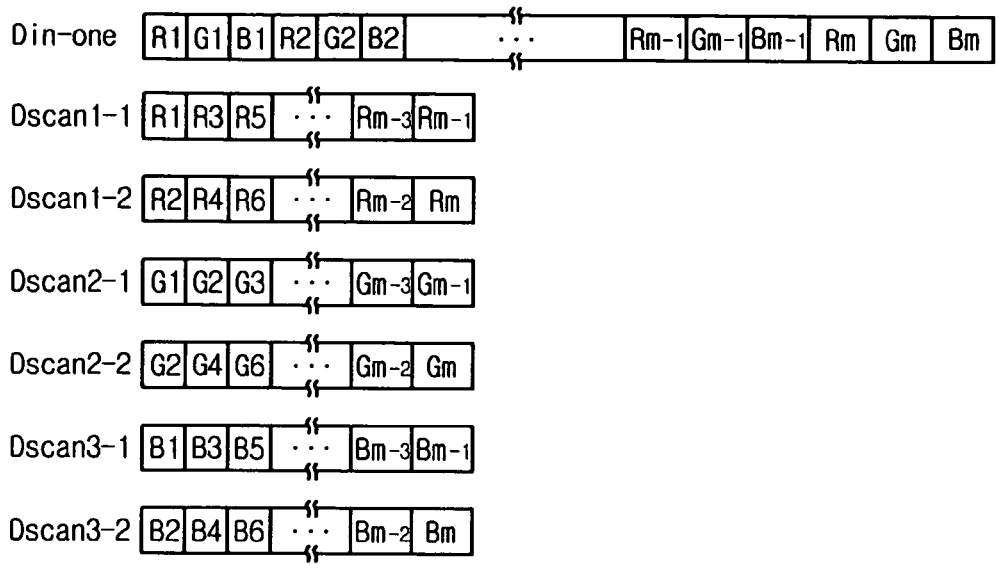
FIG. 7 illustrates data streams applied to the EL display device according to the embodiment of the present invention.

FIG. 7 is a formatting diagram of the data stream applied to the EL display device according to an embodiment of the present invention. Here, it will be assumed that the multiplexer part operates in response to two multiplex clock signals and the red, green and blue subpixels constructing a color pixel are connected to the same data line DL, as shown in FIGS. 4 and 5. Therefore, the video data stream to be applied to the subpixels on one line in the related art EL display device is divided into 6 video data streams similarly to the scan signal.

Referring to FIG. 7, the video data stream Din-one supplied to the timing controller 460 in the EL display device according to an embodiment of the present invention. The input video data stream is classed in red, green and blue subpixel data streams, by the timing controller 460. The timing controller 460 divided each of the red, green and blue subpixel data streams into odd and even subpixel data streams. Consequently, the input video data stream Din-one to be applied to the subpixels of one line in the related art EL display device is rearranged into six subpixel data streams Dscan1_1 to Dscan3_2, as shown in FIG. 7, by the timing controller 460. The subpixel data streams Dscan1_1 and Dscan1_2 include odd red subpixel data and even red subpixel data, repectively. The subpixel data streams Dscan2_1 and Dscan2_2 include odd green subpixel data and even green subpixel data, repectively. The subpixel data streams Dscan3_1 and Dscan3_2 include odd blue subpixel data and even blue subpixel data, repectively. The six subpixel data streams Dscan1_1 to Dscan3_2 rearranged in the timing controller 460 are sequentially applied to the data D-IC 430. In the related art EL display device, the input video data stream Din-one is applied to the data D-IC 20 via the timing controller 26 in original format.

The data D-IC 430 supplies the j odd data lines DL1 to DLk−1 with the j data signals each corresponding to j odd red subpixel data included in the subpixel data stream Dscan1_1 through the multiplexer part 450 when the 1_1 scan signal Scan1_1 and the first select signal MUXCLK1 are turned on. The j data signals each depending on j even red subpixel data in the subpixel data stream Dscan1_2 are applied from the data D-IC 430 to the even data lines DL2 to DLk through the multiplexer part 450 while the 1_2 scan signal Scan1_2 and the second select signal MUXCLK2 are turned on. Similarly, the j data signals each depending on j odd green subpixel data in the subpixel data stream Dscan2_1 are applied from the data D-IC 430 to the odd data lines DL1 to DLk−1 through the multiplexer part 450 if the 2_1 scan signal Scan2_1 and the first select signal MUXCLK1 are turned on. When the 2_2 scan signal Scan2_2 and the second select signal MUXCLK2 are enabled, the j data signals according to the j even green subpixel data in the subpixel data stream Dscan2_2 are supplied to the j even data lines DL2 to DLk from the data D-IC 430 through the multiplexer part 450. In the period that the 3_1 scan signal Scan3_1 and the first select signal MUXCLK1 are enabled, the j data signals corresponding to the j odd blue subpixel data in the subpixel data stream Dscan3_1 are provided to the odd data lines DL1 to DLk−1 from the data D-IC 430 via the multiplexer part 450. Finally, the j data signals responsive to the j even blue subpixel data in the subpixel data stream Dscan3_2 are also applied to the j even data lines DL2 to DLk from the data D-IC 430 through the multiplexer part 450 in the interval that the 3_2 scan signal Scan3_2 and the second select signal MUXCLK2 are turned on.

Accordingly, in this embodiment, two multiplex clock signals are used and the scan lines are used six times more than the related art scan lines. As described above, the first select signal MUX CLK1 is turned on while one of the 1_1 scan signal Scan1_1 to the n_1 scan line ScanN_1 are turned on. Therefore, data are inputted to the odd subpixels. Then, when the first select signal MUX CLK1 is turned off, the turned-off scan signal (that is, one of the 1_1 scan signal Scan1_1 to the n_1 scan signal Scann_1) is also turned off. Consequently, the number of the output chanels OC1 to OCj of the data D-IC 430 can be reduced. The 1_1 scan signal Scan1_1 to the n_1 scan signal Scann_1 are connected to the odd subpixels, and the 1_2 scan signal Scan1_2 to the n_2 scan signal Scann_2 are connected to the even subpixels in an alternating fashion.

According to embodiments of the present invention, the multiplexer part is formed in the EL display panel for the 1:i matching between the output channels of the data D-IC and the data lines (where "i" is a positive integer greater than 1). In addition, the pixels are connected to the odd and even scan lines in an alternating fashion, and the pixel part is formed as a vertical stripe type. Therefore, the number of the output channels of the data D-IC is reduced by at least ⅙, thereby manufacturing a more compact EL display panel.

It will be apparent to those skilled in the art that various modifications and variations can be made in the present invention. For example, in FIGS. 4 and 5 the multiplexer part 450 can be eliminated while each of the output channels OC1 to OCj of the data D-IC 430 can be connected to at least two of the data lines DL. Thus, it is intended that the present invention covers the modifications and variations of this invention provided they come within the scope of the appended claims and their equivalent.

What is claimed is:

1. A method of driving an electro-luminescence display device including an electro-luminescence display panel including red, green, and blue subpixels at regions defined by a plurality of data lines and a plurality of scan lines, a scan driver integrated circuit for driving the scan lines and a data driver integrated circuit for driving the data lines, and a multiplexer part for selectively connecting output channels of the data driver integrated circuit to one of at least every two of the data lines, the method comprising:

supplying the multiplexer part with select signals of at least two multiplex clock signals;

applying a first select signal of the multiplex clock signals to connect output channels of the data driver integrated circuit to subpixels connected to odd scan lines; and applying a second select signal of the multiplex clock signals to connect output channels of the data driver integrated circuit to subpixels connected to even scan lines, wherein each of pixels includes an electro-luminescent cell connected between a power source and a ground source, wherein the first select signal is switched on and off at every ⅙ of 1 horizontal period, and the second select signal is switched to a state opposite to that of the first select signal, wherein the scan driver integrated circuit includes a first scan driver integrated circuit for driving a first set of scan lines and a second scan driver integrated circuit for driving a second set of scan lines, wherein scan pulses maintaining on-state during ⅙ of 1 horizontal period are sequentially supplied to the scan lines, wherein the red, green, and blue subpixels are alternatingly arranged in columns with the plurality of data lines and form a unit pixel wherein each of scan lines of the first scan driver integrated circuit corresponds with each of scan lines of the second scan driver integrated circuit, wherein a pair of scan lines of the first and the second scan driver integrated circuit are directly next to each other and the pair of scan lines are alternately connected to a plurality of subpixels arranged in a row, wherein all subpixels in each row correspond only to one color among red, green, or blue, such that the pair of scan lines supply scan signals to only subpixels of the one color in the row, and wherein the plurality of subpixels is disposed between the pairs of scan lines in the row.

2. The method according to the claim 1, wherein the first scan driver integrated circuit and the second scan driver integrated circuit are operated by a single control signal supplied from a timing controller at the same time.

* * * * *